US007632619B2

(12) United States Patent
Mikuriya et al.

(10) Patent No.: US 7,632,619 B2
(45) Date of Patent: Dec. 15, 2009

(54) TONER, FIXING METHOD AND IMAGE FORMING METHOD USING THE TONER

(75) Inventors: Yoshihiro Mikuriya, Nishinomiya (JP); Atsushi Yamamoto, Kawanishi (JP); Hiroaki Katoh, Nagaokakyo (JP); Takuya Kadota, Kobe (JP); Masayuki Hagi, Minoh (JP); Katsunori Kurose, Takarazuka (JP); Masahide Inoue, Katsuragi (JP)

(73) Assignee: Ricoh Company Limited, Tokyo (JP)

( * ) Notice: Subject to any disclaimer, the term of this patent is extended or adjusted under 35 U.S.C. 154(b) by 366 days.

(21) Appl. No.: 11/454,940

(22) Filed: Jun. 19, 2006

(65) Prior Publication Data

US 2006/0292474 A1 Dec. 28, 2006

(30) Foreign Application Priority Data

Jun. 17, 2005 (JP) ..... 2005-177506
Apr. 10, 2006 (JP) ..... 2006-107554

(51) Int. Cl.
*G03G 9/08* (2006.01)

(52) U.S. Cl. ..... 430/108.8; 430/108.1; 430/109.1; 430/109.3; 430/109.4; 430/124.3; 430/123.5

(58) Field of Classification Search ..... 430/108.1, 430/108.8, 109.1, 109.3, 109.4, 123.5, 124.3
See application file for complete search history.

(56) References Cited

U.S. PATENT DOCUMENTS

2003/0027074 A1* 2/2003 Emoto et al. ..... 430/124
2003/0152857 A1* 8/2003 Sugiura et al. ..... 430/109.2
2004/0229142 A1* 11/2004 Dojo et al. ..... 430/106.1

FOREIGN PATENT DOCUMENTS

JP 10-161335 6/1998
JP 2004-109697 4/2004
JP 2004-126268 4/2004

OTHER PUBLICATIONS

U.S. Appl. No. 11/857,175, filed Sep. 18, 2007, Matsumoto et al.
U.S. Appl. No. 11/963,279, filed Dec. 21, 2007, Mikuriya et al.
U.S. Appl. No. 11/696,879, filed Apr. 5, 2007, Yasunaga et al.

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A toner including a binder resin, a wax, and a colorant, wherein particles of the wax having a particle diameter of less than 1.00 μm are included in the toner in an amount of not less than 35% by number and less than 55% by number, and wherein the wax has a particle diameter distribution property such that when particle diameters of particles of the wax are classified into ranges having a width of 0.05 μm, the wax has a particle diameter mode value that is not less than 0.75 μm and less than 1.00 μm; and a fixing method and an image forming method using the above toner.

13 Claims, 1 Drawing Sheet

OTHER PUBLICATIONS

U.S. Appl. No. 11/772,404, filed Jul. 2, 2007, Nakamura et al.
U.S. Appl. No. 11/851,048, filed Sep. 6, 2007, Murakami et al.
U.S. Appl. No. 11/851,617, filed Sep. 7, 2007, Murakami et al.
U.S. Appl. No. 11/855,759, filed Sep. 14, 2007, Katoh et al.
U.S. Appl. No. 11/856,248, filed Sep. 17, 2007, Murakami et al.
U.S. Appl. No. 11/855,739, filed Sep. 14, 2007, Fuwa et al.
U.S. Appl. No. 11/924,994, filed Oct. 26, 2007, Katoh et al.
U.S. Appl. No. 11/965,522, filed Dec. 27, 2007, Fuwa et al.
U.S. Appl. No. 12/051,248, filed Mar. 19, 2008, Hagi et al.
U.S. Appl. No. 12/010,369, filed Jan. 24, 2008, Yasunaga et al.
U.S. Appl. No. 12/027,704, filed Feb. 7, 2008, Fuwa et al.
U.S. Appl. No. 12/048,865, filed Mar. 14, 2008, Yasunaga et al.
U.S. Appl. No. 12/197,651, filed Aug. 25, 2008, Katoh et al.
U.S. Appl. No. 12/241,656, filed Sep. 30, 2008, Yasunaga et al.

* cited by examiner

TONER, FIXING METHOD AND IMAGE FORMING METHOD USING THE TONER

BACKGROUND OF THE INVENTION

1. Field of the Invention

The present invention relates to a toner for use in electrophotography. In addition, the present invention also relates to a fixing method and an image forming method using the toner.

2. Discussion of the Background

When a toner image formed by an electrophotographic image forming method is fixed, heat roller fixing methods are typically used. In heat roller fixing methods, a toner image is contacted with a heat roller upon application of pressure to be heated and melted. Therefore, the heat roller fixing methods tend to cause an offset problem in that part of a fused toner image is adhered and transferred to the surface of the heat roller, and then the part of the toner image is re-transferred to an undesired portion of the sheet itself or the following sheet of a recording material. In attempting to prevent occurrence of the offset problem, a technique in which a fixing oil such as a silicon oil is applied or penetrated to the heat roller is proposed. On the other hand, the heat roller fixing methods tend to cause another problem in that a recording material having a toner image thereon winds around a heat roller (this phenomenon is hereinafter referred to as a winding problem). In attempting to prevent occurrence of the winding problem, a technique in which a separation mechanism (such as a separation pick and a separation plate) configured to separate the recording material and the heat roller is arranged on the heat roller is proposed.

However, in order to downsize image forming apparatus, oilless fixing devices without a fixing oil applying system have been typically used. In this case, the toner adhered to the heat roller tends to damage the separation mechanism, and as a result, the recording material cannot be well separated from the heat roller.

In attempting to solve these problems, a technique in which a wax (such as polypropylene and polyethylene) is included in a toner to improve the ability of the toner to separate a toner image from a fixing member such as a heat roller (this ability is hereinafter referred to as separativeness) and releasability of the toner itself is proposed. However, a wax having relatively low polarity cannot be well dispersed in a polyester resin having relatively high polarity, which is typically used in toners.

In attempting to solve this problem, modified waxes such as oxidized polyolefin waxes having a polar group on the end thereof have been used. Such waxes can be well dispersed in polyester resins. However, since modified waxes typically have relatively high viscosity compared to unmodified waxes, such waxes cannot function as a release agent, i.e., a toner including such a wax has low releasability, separativeness and hot offset resistance.

On the other hand, a technique in which the surface of a heat roller is covered with materials having good releasability (such as fluorocarbon resins) is proposed. However, such a heat roller has poor reproducibility and durability.

It is relatively difficult to improve hot offset resistance and separativeness of full color toners compared to cases using monochrome toners. This is because the viscosity of full color toners is decreased so that the surface of a full color toner image is smoothened to some extent to obtain a brilliant full color image having good glossiness, transparency and color reproducibility. However, such a toner having low viscosity tends to adhere to a heat roller when the toner is heat-melted, due to deterioration of the intermolecular cohesive force thereof. It is possible to improve separativeness and hot offset resistance by increasing elasticity of the toner, but the produced image has poor glossiness. It is difficult for full color toners to produce high quality images while having good fixability.

In attempting to solve these problems, Japanese patent No. 3458629 discloses a toner including wax particles having, a particle diameter of less than 1 μm in an amount of from 55 to 95% by number based on the total number of wax particles. However, since wax particles having a particle diameter of less than 1 μm tend not to immediately exude to the surface of the toner particles, such a toner has poor separativeness.

Published unexamined Japanese patent application No. (hereinafter referred to as JP-A) 2004-126268 discloses a toner including a wax having a particle diameter distribution property such that a top peak is present in a particle diameter range of from 1.0 to 1.5 μm, wherein wax particles having a particle diameter of not less than 1.0 μm and less than 1.5 μm are included in the toner in an amount of not less than 20% by number and less than 40% by number. In this case, especially when the toner is used in a one-component developer, a problem in that the toner tends to firmly adhere to a developing blade or a photoreceptor is caused.

These techniques are still insufficient to provide a toner having a good combination of oilless fixability, developability, and cleanability.

SUMMARY OF THE INVENTION

Accordingly, an object of the present invention is to provide a toner having a good combination of the following properties:

(1) separativeness;
(2) hot offset resistance;
(3) toner filming resistance; and
(4) thermostable preservability.

In this regard, "separativeness" means an ability of a toner to separate a toner image from a fixing member (such as a heat roller).

Another object of the present invention is to provide an oilless fixing method by which full color images having high glossiness and good color reproducibility can be stably produced.

Another object of the present invention is to provide an image forming method by which high quality images can be produced for a long period of the time.

These and other objects of the present invention, either individually or in combinations thereof, as hereinafter will become more readily apparent can be attained by a toner, comprising:

a binder resin;
a wax; and
a colorant, wherein particles of the wax having a particle diameter of less than 1.00 μm are included in the toner in an amount of not less than 35% by number and less than 55% by number, and wherein the wax has a particle diameter distribution property such that when particle diameters of particles of the wax are classified into ranges having a width of 0.05 μm, the wax has a particle diameter mode value that is not less than 0.75 μm and less than 1.00 μm; and a fixing method and an image forming method using the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
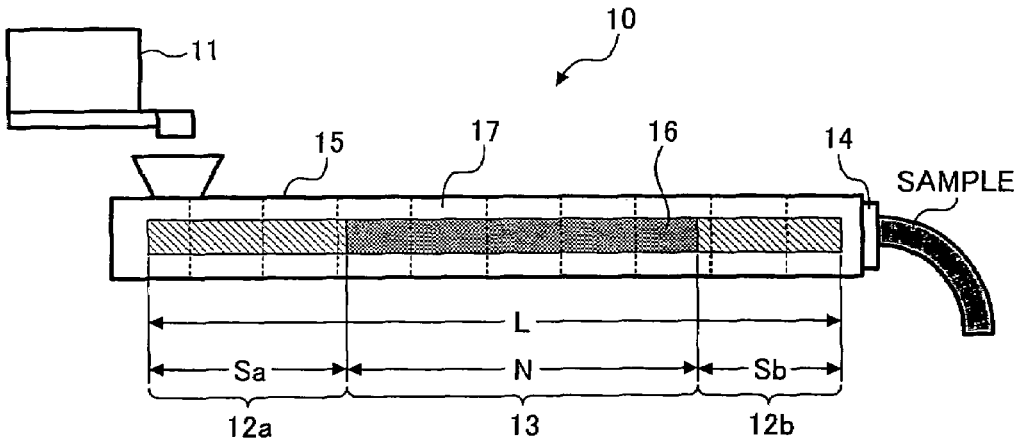
FIG. 1 is a schematic view illustrating an embodiment of the kneader for preparing the toner of the present invention.

The toner of the present invention includes a binder resin, a wax and a colorant. The wax is dispersed in the binder resin. Particles of the wax having a particle diameter of less than 1.00 μm are included in the toner in an amount of not less than 35% by number and less than 55% by number, and the wax has aparticle diameterdistribution propertysuch that whenparticle diameters of particles of the wax are classified into ranges having a width of 0.05 μm, the wax has a particle diameter mode value that is not less than 0.75 μm and less than 1.00 μm. In other words, the wax dispersed in the toner has a specific particle diameter distribution property.

The toner of the present invention is preferably prepared as follows:

(1) melt-kneading a mixture of toner compositions (such as a binder resin, a wax, and a colorant);
(2) cooling the melt-kneaded mixture;
(3) pulverizing the cooled mixture; and
(4) classifying the pulverized mixture to prepare toner particles.

In this regard, "toner" includes the above toner particles and the above cooled mixture. In other words, the wax has a specific particle diameter distribution property not only in the toner particles but also in the melt-kneaded and cooled mixture of the toner compositions which is not subjected to pulverization and classification.

As mentioned above, particles of the wax having a particle diameter of less than 1.00 μm are included in the toner of the present invention in an amount of not less than 35% by number and less than 55% by number. The amount of the wax particles includes all values and subvalues therebetween, especially including 37.5, 40, 42.5, 45, 47.5, 50, and 52.5% by number. In addition, the wax preferably has a particle diameter distribution property such that when particle diameters of particles of the wax are classified into ranges having a width of 0.05 μm, the wax has a particle diameter mode value that is not less than 0.75 μm and less than 1.00 μm, and more preferably not less than 0.80 μm and less than 1.00 μm. The mode value includes all values and subvalues therebetween, especially including 0.80, 0.85, 0.90, and 0.95 μm.

A toner including a wax having the above particle diameter distribution property shows a good separativeness when it is used in a so-called oilless fixing system in which no oil is applied to a fixing roller.

In addition, wax particles are hardly exposed at the surface of such toner particles, and hardly released from such toner particles even after being agitated in a developing unit. As a result, the toner including such a wax has a good combination of separativeness, hot offset resistance, toner filming resistance, thermostable preservability and glossiness of the produced image.

For this reason, even if the toner includes the wax at high concentration, the wax having the above particle diameter distribution property hardly contaminates image forming members (such as a photoreceptor, an intermediate transfer member, a developing sleeve). As a result, the image forming members have high durability, resulting in production of high quality images for a long period of time. When the toner is used as a full color toner, the toner can produce images having high glossiness and good color reproducibility without causing the winding problem and the hot offset problem.

When the wax particle diameter distribution is shifted to a larger particle diameter side, for example, when particles of the wax having a particle diameter of less than 1.00 μm are included in the toner in an amount of less than 35% by number, relatively large wax particles tend to release from the toner particles when the toner is agitated in a developing device of an image forming apparatus. As a result, wax particles having small particle diameter are retained in the toner particles, and too little an amount of the wax is included in the toner. Thereby, separativeness of the toner deteriorates.

In contrast, when particles of the wax having a particle diameter of less than 1.00 μm are included in the toner in an amount of not less than 55% by number, the wax has too small an average particle diameter, and therefore the wax cannot exude to the surface of the toner particles, resulting in deterioration of separativeness of the toner.

It is more preferable that particles of the wax having a particle diameter of not less than 1.00 μm and less than 2.00 μm are included in the toner in an amount of not less than 42.5% by number and less than 55% by number. The amount of such wax particles includes all values and subvalues therebetween, especially including 45, 47.5, 50, and 52.5% by number. In this case, separativeness of the toner further improves.

It is even more preferable that particles of the wax having a particle diameter of not less than 0.75 μm and less than 1.25 μm are included in the toner in an amount of not less than 45% by number and less than 55% by number. The amount of such wax particles includes all values and subvalues therebetween, especially including 47.5, 50, and 52.5% by number. In this case, separativeness and thermostable preservability of the toner further improves.

In addition, it is preferable that particles of the wax having a particle diameter of not less than 0.75 μm and less than 1.00 μm are included in the toner in an amount of not less than 20% by number and less than 35% by number. The amount of such wax particles includes all values and subvalues therebetween, especially including 22.5, 25, 27.5, 30, and 32.5% by number. In this case, the toner hardly adheres firmly to a developing sleeve, and toner filming on a photoreceptor hardly occurs.

In the present invention, a particle diameter distribution of a wax is determined by the following method. At first, toner particles are embedded in an epoxy resin so as to be cut into an ultrathin section having a thickness of about 100 nm. The ultrathin section is stained with ruthenium tetroxide to distinguish a resin phase and a wax phase. The thus prepared sample is observed by a transmission electron microscope (TEM) at a magnification of 10,000 times to obtain toner section images. Average particle diameters of 100 randomly selected wax particles are measured from the section images. A histogram in which the average particle diameter is plotted on the X-axis at an interval of 0.05 μm and the number distribution is plotted on the Y-axis is prepared to obtain a wax particle diameter distribution. When wax particles are not spherical (e.g., spindle), the average particle diameter D is defined as follows:

$$D=(A+B)/2$$

wherein A represents a major axis and B represents a minor axis.

A wax for use in the toner of the present invention has no affinity for a binder resin, i.e., the wax is insoluble in the binder resin. Any known waxes used for conventional toners can be used for the toner of the present invention.

Specific examples of the waxes include polyolefin waxes (e.g., polyethylene wax, polypropylene wax), acid-modified waxes (e.g., oxidized polyethylene wax, oxidized polypropylene wax), natural waxes (e.g., carnauba wax, rice wax), montan waxes, Fischer-Tropsch waxes, paraffin waxes, polymer alcohol waxes, etc. Among these, hydrocarbon waxes such as paraffin waxes are preferably used in order to improve separativeness of the toner. For example, atoner including a polyester resin and a hydrocarbon wax, which has appropriate affinity for the polyester resin, has good separativeness.

The acid-modified waxes typically have high dispersibility in binder resins. The acid-modified waxes can be prepared by an addition reaction of a monomer including a carboxyl group and a polymerizable double bond, to a polyolefin (e.g., polyethylene, polypropylene). The monomer is selected from the group consisting of acrylic acid, methacrylic acid, maleic acid, and maleic anhydride. These monomers are used alone or in combination.

The acid-modified waxes preferably have an acid value of from 0.5 to 20 KOHmg/g, and more preferably from 1 to 5 KOHmg/g. The acid value includes all values and subvalues therebetween, especially including 1, 2, 3, 4, 5, 6, 7, 8, 9, 10, 11, 12, 13, 14, 15, 16, 17, 18, and 19 KOHmg/g.

The toner of the present invention preferably includes only one kind of wax in terms of dispersibility of the wax, i.e., controlling the wax particle diameter distribution.

The wax for use in the toner of the present invention preferably has a melting point of from 65 to 75° C. The melting point includes all values and subvalues therebetween, especially including 66, 67, 68, 69, 70, 71, 72, 73, and 74° C. When the melting point is too low, thermostable preservability of the toner deteriorates. When the melting point is too high, low-temperature fixability of the toner deteriorates.

The melting point of a wax is determined by a differential scanning calorimetry (DSC). The DSC curve is obtained using an instrument such as a differential scanning calorimeter DSC-200 (from Seiko Instruments Inc.). A peak temperature observed in the DSC curve represents the melting point.

The toner of the present invention preferably includes a wax in an amount of from 3.5 to 5.0% by weight based on the total weight of a binder resin and the wax. The amount of the wax includes all values and subvalues therebetween, especially including 3.6, 3.7, 3.8, 3.9, 4.0, 4.1, 4.2, 4.3, 4.4, 4.5, 4.6, 4.7, 4.8, and 4.9% by weight. In this case, the toner has a good combination of separativeness and thermostable preservability. In addition, such a toner hardly firmly adheres to a developing sleeve, and the toner filming on a photoreceptor hardly occurs. When the amount of the wax is too small, separativeness of the toner deteriorates. When the amount of the wax is too large, thermostable preservability of the toner deteriorates, and the toner tends to produce abnormal images.

As mentioned above, the toner preferably includes only one kind of wax. However, the toner can include two or more waxes, if desired. In this case, the total amount of plural waxes may satisfy the above-mentioned range. A target wax particle diameter distribution and a target melting point of the wax may be obtained by using a mixture of the plural waxes.

The wax may be added to a binder resin at a time of mixing toner compositions, however, it is preferable that the wax is added to a binder resin at a time of synthesis thereof. By previously dispersing the wax in the binder resin, the wax can be stably and uniformly dispersed in the toner.

Any known binder resins used for conventional toners can be used for the toner of the present invention. Specific examples of the binder resins include condensation resins (e.g.,polyester resin), vinyl resins (e.g., (meth)acrylic resin, styrene-(meth)acrylic copolymer), cyclic olefin resins (e.g., epoxy resin, TOPAS-COC from 'Ticona), etc.

As the condensation resin, polyester resins formed by polycondensation reaction between a polyol and a polycarboxylic acid can be used.

As the polyol, diols and polyols having three or more valences can be used.

Specific examples of the diols include alkylene oxide adducts of bisphenol A (e.g., polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane)), ethylene glycol, diethylene glycol, triethylene glycol, 1,2-propylene glycol, 1,3-propylene glycol, 1,4-butanediol, neopentyl glycol, 1,5-pentanediol, 1,6-hexanediol, 1,4-cyclohexanedimethanol, dipropylene glycol, polyethylene glycol, polytetramethylene glycol, bisphenol A, hydrogenated bisphenol A, etc.

Specific examples of the polyols having three or more valences include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc.

As the polycarboxylic acid, dicarboxylic acids and polycarboxylic acids having three or more valences can be used.

Specific examples of the dicarboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, an hydrides and lower alkyl esters of these acids, etc.

Specific examples of polycarboxylic acids having three or more valences include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, anhydrides and lower alkyl esters of these acids, etc.

Hybrid resins having a condensation resin skeleton and a vinyl resin skeleton can be preferably used in the toner of the present invention. Hybrid resins can be prepared by the following method:

(1) mixing a raw material monomer of a condensation resin skeleton, a raw material monomer of a vinyl resin skeleton, and a monomer capable of reacting with both of the above raw material monomers, in a vessel;

(2) subjecting these monomers simultaneously to a condensation polymerization reaction to prepare the condensation resin skeleton, and a radical polymerization reaction to prepare the vinyl resin skeleton.

The monomer capable of reacting with both of the raw material monomers is, in other words, a monomer capable of condensation polymerization reaction and radical polymerization reaction, for example, a monomer including a carboxyl group capable of condensation polymerization reaction and a vinyl group capable of radical polymerization reaction. Specific examples of such monomers include fumaric acid, maleic acid, acrylic acid, methacrylic acid, etc.

Specific examples of the raw material monomers of a condensation resin skeleton include the above-mentioned polyols, polycarboxylic acid, etc.

Specific examples of the raw material monomers of a vinyl resin skeleton include styrene derivatives (e.g., styrene, o-methylstyrene, m-methylstyrene, p-methylstyrene, α-methylstyrene, p-ethylstyrene, 2,4-dimethylstyrene, p-tert-butylstyrene, p-chlorostyrene), ethylene-type unsaturated monoolefins (e.g., ethylene, propylene, butylene, isobutylene), alkyl esters of methacrylic acids (e.g., methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-methylbutyl methacrylate, hexyl methacrylate, octyl methacrylate, nonyl methacrylate, decyl methacrylate, undecyl methacrylate, dodecyl methacrylate), alkyl esters of acrylic acids (e.g., methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-methylbutyl acrylate, hexyl acrylate, octyl acrylate, nonyl acrylate, decyl acrylate, undecyl acrylate, dodecyl acrylate), unsaturated carboxylic acids (e.g., acrylic acid, methacrylic acid, itaconic acid, maleic acid), acrylonitriles, maleates, itaconates, vinyl chlorides, vinyl acetates, vinyl benzoates, methyl vinyl ketones, ethyl vinyl ketones, hexyl vinyl ketones, methyl vinyl ethers, ethyl vinyl ethers, isobutyl vinyl ethers, etc.

Specific examples of radical polymerization initiators for use in the radical polymerization reaction to prepare the vinyl resin skeleton includes azo or diazo initiators (e.g., 2,2'-azobis-(2,4-dimethylvaleronitrile), 2,2'-azobis(isobutyronitrile), 1,1'-azobis(cyclohexane-1-carbonitrile), 2,2'-azobis-4-methoxy-2,4-dimethylvaleronitrile), peroxide initiators (e.g., benzoyl peroxide, methyl ethyl ketone peroxide, isopropyl peroxycarbonate, lauroyl peroxide), etc.

The binder resin preferably has an acid value of from 1 to 50 KOHmg/g, and more preferably from 1 to 40 KOHmg/g. The acid value includes all values and subvalues therebetween, especially including 5, 10, 15, 20, 25, 30, and 35 KOHmg/g. In particular, polyester resins having such an acid value can well disperse colorants (such as carbon black), and can impart good chargeability to the resultant toner.

When the binder resin includes two or more resins, the mixed binder resin may have the above-mentioned acid value.

To improve separativeness and hot offset resistance of the toner, the binder resin preferably includes a first binder resin having a softening point of not less than 100° C. and less than 120° C., and a second binder resin having a softening point of from 120 to 140° C. in an amount of from 50 to 75% by weight based on the first binder resin. It is more preferable that the first binder resin has a softening point of from 105 to 115° C., and the second binder resin has a softening point of from 125 to 135° C. The softening point of the first binder resin includes all values and subvalues therebetween, especially including 105, 110, and 115° C. The softening point of the second binder resin includes all values and subvalues therebetween, especially including 120, 125, 130, and 135° C. The amount of the second binder resin includes all values and subvalues therebetween, especially including 55, 60, 65, and 70% by weight based on the first binder resin.

To improve thermostable preservability of the toner, the first and the second binder resins respectively preferably have a glass transition temperature of from 50 to 75° C., and more preferably from 55 to 70° C. The glass transition temperature includes all values and subvalues therebetween, especially including 50, 55, 60, 65, and 70° C.

Specific examples of the first binder resins include condensation resins such as polyester resins formed by polycondensation reaction between the above-mentioned polyol and the above-mentioned polycarboxylic acid. A polyester resin formed by a polycondensation reaction between an alkylene oxide adducts of bisphenol A (serving as a polyol) and a terephthalic acid and/or a fumaric acid (serving as polycarboxylic acids) is preferably used.

Specific examples of the second binder resins include condensation resins such as polyester resins formed by polycondensation reaction between monomers at least including (1) the above-mentioned polyol having three or more valences or (2) the above-mentioned polycarboxylic acid having three or more valences. A polyester resin formed by a polycondensation reaction between (1) an alkylene oxide adduct of bisphenol A (serving as a diol) and (2) a trimellitic acid (serving as a polycarboxylic acid having three or more valences) and (3) one or more dicarboxylic acids selected from the group consisting of terephthalic acid, fumaric acid, and dodecenylsuccinic acid, is preferably used.

As the second binder resin, the above-mentioned hybrid resins having a condensation resin skeleton and a vinyl resin skeleton can be preferably used. Such hybrid resins can impart a good combination of wax-dispersibility, stiffness, fixability, and hot offset resistance to the toner. In this case, raw material monomers of the second binder resin include raw material monomers of the vinyl resin skeleton in an amount of from 5 to 30% by weight, and more preferably from 10 to 25% by weight, based on total raw material monomers. The amount of the raw material monomers of the vinyl resin skeleton includes all values and subvalues therebetween, especially including 10, 15, 20, and 25% by weight.

In terms of improving hot offset resistance of the toner, the second binder resin preferably includes an insoluble constituent in tetrahydrofuran (THF) in an amount of from 0.1 to 30% by weight, and more preferably from 0.1 to 10% by weight. The amount of the THF-insoluble constituent includes all values and subvalues therebetween, especially including 1, 5, 10, 15, 20, and 25% by weight.

In the present invention, it is preferable that the wax is added to the binder resin at a time of synthesis of the binder resin, i.e., raw material monomers of the binder resin are preferably polymerized in the presence of the wax. The thus prepared resin will be hereinafter referred to as a wax-containing resin.

When the binder resin includes the first binder resin (i.e., low-molecular-weight resin) and the second binder resin (i.e., high-molecular-weight resin), the second resin is preferably synthesized in the presence of the wax. This is because the wax cannot be otherwise well dispersed in such a binder resin having high molecular weight.

Wax particles included in the wax-containing resin preferably have a particle diameter of from 2.0 to 4.0 μm. The particle diameter includes all values and subvalues therebetween, especially including 2.5, 3.0, 3.5 μm. When the particle diameter is too small, separativeness of the toner deteriorates. When the particle diameter is too large, a particle diameter distribution broadens when the resin is kneaded in the toner manufacturing process, because each of the wax particles is easily unite each other.

The wax-containing resin is prepared by condensation-polymerizing (and radical-polymerizing, if desired) an acid monomer and an alcohol monomer (and a raw material monomer of a vinyl resin skeleton, if desired) in the presence of the wax. A toner including such a resin can well disperse the wax.

Therefore, such a toner has good separativeness, hot offset resistance, toner filming resistance, and thermostable preservability.

Any known colorants used for conventional toners can be used for the toner of the present invention. Specific examples of the colorants include carbon black, aniline blue, chalco oil blue, chrome yellow, Ultramarine blue, Oil Red, Quinoline Yellow, Methylene Blue Chloride, copper phthalocyanine, Malachite Green Oxalate, Lamp Black, Rose Bengal, C. I. Pigment Red 48:1, C. I. Pigment Red 122, C. I. Pigment Red 57:1, C. I. Pigment Red 184, C. I. Pigment Yellow 97, C. I. Pigment Yellow 12, C. I. Pigment Yellow17, C. I. Solvent Yellow 162, C. I. Pigment Yellow 180, C. I. Pigment Yellow 185, C. I. Pigment Blue 15:1, C. I. Pigment Blue 15:3, etc. The toner of the present invention preferably includes a colorant in an amount of from 2 to 15% by weight based on the binder resin (and the wax, if the binder resin is a wax-containing resin). The amount of the colorant includes all values and subvalues therebetween, especially including 3, 4, 5, 6, 7, 8, 9, 10, 11, 12, 13, and 14% by weight.

The colorant can be combined with a resin to be used as a master batch. A master batch is prepared by melt-kneading a colorant and a binder resin followed by cooling and pulverization. When a master batch is used, the toner includes the master batch in an amount so that the toner includes the colorant in an amount of the above-mentioned range.

The toner of the present invention can include a charge controlling agent. All charge controlling agent used in conventional toners can be used in the toner of the present invention.

Specific examples of the charge controlling agents include fluorochemical surfactants, metal complexes of salicylic acid, metal-containing dyes (such as azo metallic compounds), polymer acids (such as copolymers including a maleic acid as a monomer constituent), calixarene compounds, organic boron compounds, etc.

The toner of the present invention can be prepared by the following method:

(1) melt-kneading a mixture of toner compositions (such as a binder resin, a wax, a colorant);
(2) cooling the melt-kneaded mixture;
(3) pulverizing the cooled mixture; and
(4) classifying the pulverized mixture to prepare toner particles.

The particle diameter of the wax can be controlled by changing the kind of kneader used, or controlling operation conditions of the kneader.

Specific examples of the kneaders include batch kneaders (e.g., two-roll mills, BUMBERY'S mixers), continuous double axis kneaders (e.g., TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd, KEX EXTRUDER from Kurimoto Ltd.), and continuous single axis kneaders (e.g., KOKNEADER from Buss Corporation), etc.

An example of toner manufacturing method using a continuous extruder will be explained.

FIG. 1 is a schematic view illustrating an embodiment of a continuous extruder for preparing the toner of the present invention. A continuous extruder 10 includes a feeder 11, an ejection opening 14, a cylinder 15, a screw 16, and a barrel 17. The screw 16 is implemented in the cylinder 15. The cylinder 15 includes a first feeding zone 12*a*, a kneading zone 13, and a second feeding zone 12*b*. Toner constituents (such as a binder resin, a wax, a colorant, etc.) are fed into the continuous extruder 10 from the feeder 11. Then the toner constituents are transported to the kneading zone 13 to be kneaded via the first feeding zone 12*a*. The kneaded mixture is finally ejected from the ejection opening 14 via the second feeding zone 12*b*.

Kneading conditions such as a kneading zone ratio (aftermentioned), an inner temperature of the cylinder 15, and a revolution speed of the screw 16 can be changed as appropriate. The kneading zone ratio (r) is defined as follows:

$$r(\%)=100\times(N/L)=100\times(N/(Sa+Sb+N))$$

wherein L represents a length of the screw 16, N represents a length of the kneading zone 13, Sa represents a length of the first feeding zone 12*a*, and Sb represents a length of the second feeding zone 12*b*.

However, the configurations of the kneading zone 13 and the feeding zones 12*a* and 12*b* are not limited to that illustrated in FIG. 1.

A toner prepared under the above-mentioned conditions has a good combination of separativeness, hot offset resistance, toner filming resistance, and thermostable preservability.

As the kneading zone ratio decreases or the inner temperature of the cylinder 15 increases, the particle diameter of the wax increases. In contrast, as the kneading zone ratio increases or the inner temperature of the cylinder 15 decreases, the particle diameter of the wax decreases.

It is presumed that typical continuous extruders have a kneading zone ratio of from 10 to 30%. (For example, anextruder described in JP-A 2004-126268 has a kneading zone ratio of from 15 to 35%.) However, such extruders cannot well disperse the wax, resulting in a broad particle diameter distribution of the wax.

To obtain the toner of the present invention, the kneading zone ratio is preferably from 60 to 80%. The kneading zone ratio includes all values and subvalues therebetween, especially including 65, 70, and 75%. When the kneading zone ratio is too small, the wax particle diameter distribution widens and the average wax particle diameter increases, resulting in causing a noise in a one-component developing process or a transfer process. When the kneading zone ratio is too large, the wax particle diameter decreases, resulting in deterioration of separativeness of the toner.

The inner temperature of the cylinder 15 is preferably not less than a softening point of a binder resin, and more preferably approximately the same as the softening point of the binder resin considering the dispersibility of the wax and the colorant.

The inner temperature of the cylinder 15 is typically from 60 to 150° C., and preferably from 70 to 140° C. The inner temperature includes all values and subvalues therebetween, especially including 70, 80, 90, 100, 110, 120, 130, and 140° C. When the binder resin includes two or more resins, a softening point of a mixture of these resins is treated as that of the binder resin. When the binder resin is a wax-containing resin, a softening point of the wax-containing resin is treated as that of the binder resin.

The revolution speed of the screw 16 is typically from 50 to 200 rpm, and preferably from 70 to 150 rpm. The revolution speed includes all values and subvalues therebetween, especially including 60, 70, 80, 90, 100, 110, 120, 130, 140, 150, 160, 170, 180, and 190 rpm.

Single axis kneaders are preferably used compared to double axis kneaders. This is because toner components are retained in the kneading zone a much longer time in the single axis kneaders than in the double axis kneaders, resulting in sufficient dispersion of the wax. The toner of the present invention having a specific wax particle diameter distribution can be prepared by using a continuous single axis kneader having the above-mentioned kneading zone ratio.

As mentioned above, the toner of the present invention can be prepared by melt-kneading toner constituents (such as a binder resin, a wax, a colorant, and optionally a charge controlling agent), followed by cooling, pulverization, and classification. The particle diameter of the wax can be controlled by changing the kind of kneader used, or controlling operation conditions of the kneader. The wax may be added to a binder resin at a time of mixing toner compositions, however, it is preferable that the wax is added to a binder resin at the time of synthesis thereof.

In particular, (1) a first binder resin having a softening point of not less than 100° C. and less than 120° C., and (2) a second binder resin having a softening point of from 120 to 140 ° C. which is synthesized in the presence of a wax, are preferably used in manufacturing the toner of the present invention.

The above-mentioned toner manufacturing method can easily produce the toner of the present invention in which particles of the wax having a particle diameter of less than 1.0 μm are included in the toner in an amount of not less than 35% by number and less than 55% by number, and the wax has a particle diameter distribution property such that when particle diameters of particles of the wax are classified into ranges having a width of 0.05 μm, the wax has a particle diameter mode value that is not less than 0.75 μm and less than 1.00 μm.

The toner of the present invention preferably has a softening point of from 115 to 130° C. The softening point includes all values and subvalues therebetween, especially including 120 and 125° C. When the softening point is too low, separativeness of the toner deteriorates. When the softening point is too high, glossiness of the produced image decreases.

The toner of the present invention typically has a volume average particle diameter of from 5 to 10 μm, and preferably from 6 to 10 μm. The volume average particle diameter includes all values and subvalues therebetween, especially including 5.5, 6, 6.5, 7, 7.5, 8, 8.5, 9, and 9.5 μm.

The toner of the present invention is typically used in an electrophotographic system including an oilless fixing device. The toner can include an internal additive or an external additive according to the demand of the electrophotographic system in which the toner is used. For example, a charge controlling agent is added to a toner as an internal additive, or a hydrophobized silica is added to a toner as an external additive.

The toner of the present invention has not only good separativeness and thermostable preservability, but also good hot offset resistance, toner filming resistance, and glossiness of the produced image, even if the toner is used in an oilless fixing device.

The toner of the present invention is preferably fixed using an oilless fixing method in which a recording material (such as a paper) bearing a toner image thereon is passed through a nip formed between a heating member (such as a heating roller) and a pressing member or a heat-pressing member contacting the heating member with pressure.

The surface of the heating member preferably includes fluorocarbon resins such as PFA (tetrafluoroethylene-perfluoroalkyl vinyl ether copolymer), PTFE (poly(tetrafluoroethylene)), PVDF (poly(vinylidene fluoride)), etc.

Figure 2:
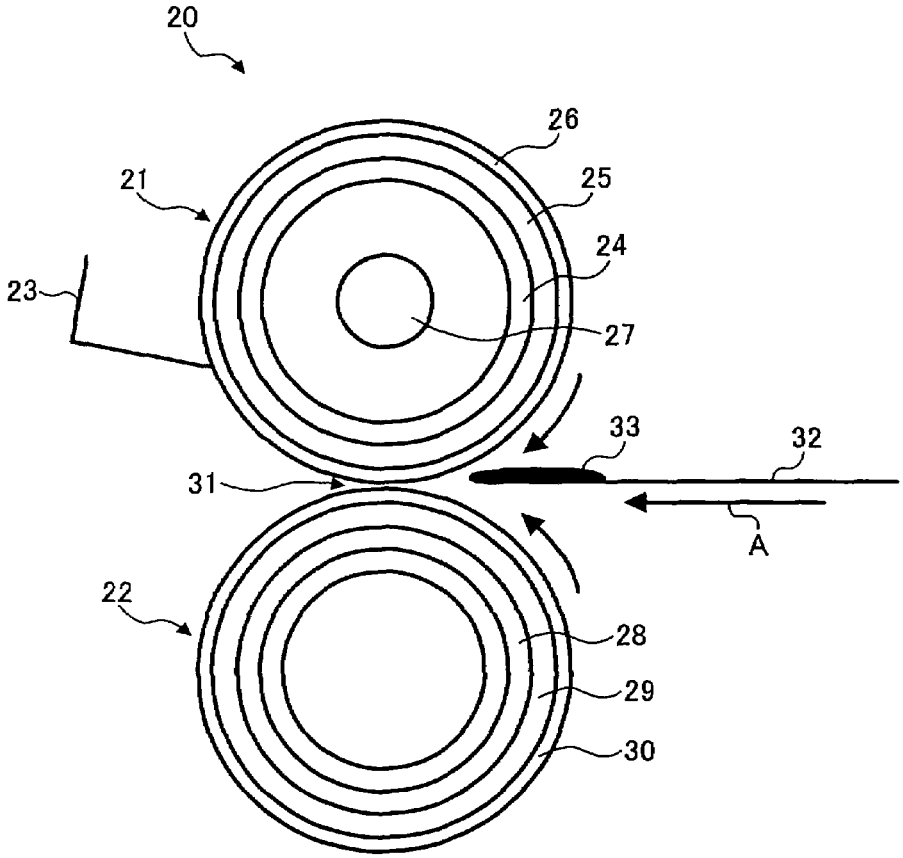
FIG. 2 is a schematic view illustrating an embodiment of the fixing device for fixing the toner of the present invention.

FIG. 2 is a schematic view illustrating an embodiment of an example of an oilless fixing device preferably used.

A fixing device 20 includes a heating roller 21 serving as a heating member, a pressing roller 22 serving as a pressing member and contacting the heating roller 21 with pressure, and a separation plate 23 configured to separate a recording sheet having a fixed toner image thereon from the heating roller 21. The heating roller 21 includes an aluminum cored bar 24, an elastic layer 25 located on the aluminum cored bar 24, an outermost layer 26 located on the elastic layer 25, and a heater 27 located inside the aluminum cored bar 24. The pressing roller 22 includes an aluminum cored bar 28, an elastic layer 29 located on the aluminum cored bar 28, an outermost layer 30 located on the elastic layer 29. The elastic layers 25 and 29 are preferably made of a silicone rubber, but are not limited thereto. The outermost layers 26 and 30 are preferably made of a fluorocarbon resin, more preferably a PFA, but are not limited thereto.

A nip 31 is formed between the heating roller 21 and the pressing roller 22. It is preferable that the nip 31 is convex upward in terms of improving separativeness between the heat roller 21 and a recording sheet 32. In other words, the recording sheet 32 having a toner image 33 thereon is prevented from winding around the heating roller 21 when the toner image 33 is fixed. The fixing is performed by passing the recording sheet 32 having the toner image 33 thereon through the nip 31 in a direction indicated by an arrow A.

The toner of the present invention can produce high quality images having good reproducibility by using such oilless fixing device.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Binder Resins (1) Preparation of Wax-Containing Hybrid Resin AWI Monomers for preparing a vinyl resin skeleton (3.8 moles of a styrene, and 0.4 moles of a butyl acrylate) and a vinyl polymerization initiator (0.1 moles of a dicumyl peroxide) were fed in a dropping funnel.

Next, alcohol monomers (1.0 mol of an ethylene oxide adduct of bisphenol A, and 1.0 mol of a propylene oxide adduct of bisphenol A) and acid monomers (0.2 moles of a derivative of succinic acid, 0.2 moles of a fumaric acid, 0.2 moles of a trimellitic acid, and 1.4 moles of a terephthalic acid) for preparing a polyester resin skeleton, an esterification catalyst (12 millimoles of a dibutyl peroxide), and a paraffin wax having a melting point of 73° C. (in an amount of 7% by weight based on the total weight of the monomers and the wax) were fed in a four necked flask equipped with a stainless stirrer, a condenser, and a nitrogen gas feed pipe. The mixture was agitated in a mantle heater under nitrogen gas stream, and the monomers for preparing a vinyl resin skeleton and the polymerization initiator were added thereto from the dropping funnel. The monomers were subjected to radical polymerization at a predetermined temperature followed by aging, and then the monomers were heated again and subjected to condensation polymerization. The polymerization reaction rate was traced by measuring a softening point of the product. The polymerization reaction was stopped when the product had a predetermined softening point, followed by cooling the product.

Thus, a wax-containing hybrid resin AWI was prepared. The components of a basic resin A of the hybrid resin AWI are shown in Table 1.

(2) Preparation of Wax-Containing Hybrid Resin AWII

The procedure for preparation of the wax-containing hybrid resin AWI was repeated except the paraffin wax having a melting point of 73° C. was replaced with a paraffin wax having a melting point of 78° C.

Thus, a wax-containing hybrid resin AWII was prepared.

(3) Preparation of Wax-Containing Hybrid Resin AWIII

The procedure for preparation of the wax-containing hybrid resin AWI was repeated except the paraffin wax having a melting point of 73° C. was replaced with a polyethylene wax having a melting point of 79° C.

Thus, a wax-containing hybrid resin AWIII was prepared.

(4) Preparation of Hybrid Resin B

The procedure for preparation of the wax-containing hybrid resin AWI was repeated except the components were changed to those for a basic resin B (described in Table 1), and no wax was added.

Thus, a hybrid resin B was prepared.

(5) Preparation of Wax-Containing Hybrid Resin CWI

The procedure for preparation of the wax-containing hybrid resin AWI was repeated except the components were changed to those for a basic resin C (described in Table 1).

Thus, a wax-containing hybrid resin CWI was prepared.

(6) Preparation of Wax-Containing Hybrid Resin DWI

The procedure for preparation of the wax-containing hybrid resin AWI was repeated except the components were changed to those for a basic resin D (described in Table 1).

Thus, a wax-containing hybrid resin DWI was prepared.

(7) Preparation of Polyester Resin F

The procedure for preparation of the wax-containing hybrid resin AWI was repeated except the components were changed to those for a basic resin F (described in Table 1), and no wax was added.

Thus, a polyester resin F was prepared.

The monomer composition of the basic resins A, B, C, D and F are shown in Table 1, the properties of these resins are shown in Table 2.

TABLE 1

| | Monomers of condensation resin skeleton | | | | | | | | Monomers of vinyl resin skeleton | | | |
|---|---|---|---|---|---|---|---|---|---|---|---|---|
| | Alcohol monomers | | | | | | | | | | | |
| | BPA- | BPA- | Acid monomers | | | | | Catalyst | Monomers | | | Initiator |
| Basic resin | EO (mol) | PO (mol) | AA (mol) | DSA (mol) | FA (mol) | TMA (mol) | TPA (mol) | DBO (mmol) | St (mol) | EHA (mol) | BA (mol) | DCP (mol) |
| A | 1.0 | 1.0 | — | 0.2 | 0.2 | 0.2 | 1.4 | 12 | 3.8 | — | 0.4 | 0.1 |
| B | — | 2.2 | 0.1 | — | 0.2 | 0.2 | 0.9 | 12 | 4.0 | 0.4 | — | 0.1 |
| C | 0.4 | 2.0 | 0.4 | 0.2 | 0.1 | 0.3 | 1.0 | 12 | 4.2 | — | 0.4 | 0.1 |
| D | 1.0 | 1.0 | 0.1 | 0.2 | 0.1 | 0.4 | 1.2 | 12 | 1.8 | — | 0.4 | 0.1 |
| F | 2.4 | 2.3 | — | 0.6 | 1.2 | 1.0 | 1.9 | 24 | — | — | — | — |

The abbreviated names of the monomers, the catalyst, and the initiator are as follows.

BPA-EO: Ethylene oxide adduct of bisphenol A

BPA-PO: Propylene oxide adduct of bisphenol A

AA: Acrylic acid

DSA: Derivative of succinic acid

FA: Fumaric acid

TMA: Trimellitic acid

TPA: Terephthalic acid

DBO: Dibutyl peroxide

St: Styrene

EHA: 2-Ethylhexyl acrylate

BA: Butyl acrylate

DCP: Dicumyl peroxide

TABLE 2

| Resin | Resin skeleton | Contained wax (Melting point) | Amount of wax (% by weight) | Softening point Tm (° C.) | Glass transition temperature Tg (° C.) |
|---|---|---|---|---|---|
| A | Hybrid | — | — | 131.6 | 67.7 |
| B | Hybrid | — | — | 132.4 | 67.3 |
| C | Hybrid | — | — | 138.9 | 66.4 |
| D | Hybrid | — | — | 125.3 | 66.2 |
| F | Polyester | — | — | 106.7 | 67.4 |
| AWI | Resin A | Paraffin (73° C.) | 7 | 131.2 | 67.2 |
| AWII | Resin A | Paraffin (78° C.) | 7 | 131.5 | 67.3 |
| AWIII | Resin A | Polyethylene (79° C.) | 7 | 131.4 | 65.5 |
| CWI | Resin C | Paraffin (73° C.) | 7 | 138.8 | 66.4 |
| DWI | Resin D | Paraffin (73° C.) | 7 | 125.1 | 66.3 |

Softening Point (Tm) Measurement Method

One (1.0) g of a sample was set in a CAPILLARY RHEOMETER SHIMADZU FLOWMETER CFT-500 (from Shimadzu Corporation), and a flow test was performed under the following conditions.

Die: diameter 0.5 mm, height 1.0 mm

Temperature rising speed: 3.0° C./min

Preheating time: 3 min

Load: 30 kg

Measurement temperature range: from 40 to 140° C. A temperature at which a half of the sample flowed out was defined as the softening point (Tm).

Glass Transition Temperature (Tg) Measurement Method

Ten (10) mg of a sample was accurately measured and fed in an aluminum pan. The aluminum pan containing the sample was set in a differential scanning calorimeter DSC-200 (from Seiko Instrument Inc.), and the glass transition temperature (Tg) of the sample was measured by the following method:

(1) the sample was heated from room temperature to 200° C. at a temperature rising speed of 30° C./min, followed by cooling;:

(2) the sample was heated again from 20° C. to 120° C. at a temperature rising speed of 10° C./min to obtain an endothermic curve of the sample.

A main shoulder peak observed in a temperature range of from 30° C. to 90° C. in the endothermic curve was defined as the glass transition temperature (Tg). An aluminum pan containing an alumina was used as a reference.

Example 1

Preparation of Master Batch

The following components were mixed using a HESCHEL MIXER.

| | |
|---|---|
| C.I. Pigment Red 57:1 (from Fuji Shikiso Co., Ltd.) | 50 parts |
| Resin AWI | 30 parts |
| Resin F | 20 parts |
| Water | 30 parts |

The mixture was kneaded for 1 hour using a two-roll mill at a roll surface temperature of 130° C. The kneaded mixture was cooled and pulverized into particles having a particle diameter of 1 mm using a pulverizer.

Thus, a master batch was prepared.

Preparation of Toner

The following components were mixed using a HENSCHEL MIXER.

| | |
|---|---|
| Resin AWI | 60 parts |
| Resin F | 40 parts |
| Master batch | 8 parts |

The mixture was melt-kneaded using a continuous kneader illustrated in FIG. 1. The kneading conditions were as follows:

Revolution speed of screw: 100 rpm

Kneading zone ratio: 70%

Internal temperature of cylinder: 100° C.

The kneaded mixture was drawn into a predetermined thickness by a cooling press roller having a thickness of 2.0 mm, and then cooled by a cooling belt. The drawn mixture was subjected to coarse pulverization with a feather mill, followed by fine pulverization with a jet pulverizer IDS (from Nippon Pneumatic Mfg. Co., Ltd.) to prepare particles having a volume average particle diameter of 6.8 μm. These particles were classified using a high accuracy airflow classifier DSX (from Nippon Pneumatic Mfg. Co., Ltd.). Thus, mother toner particles having a volume average particle diameter of 7.5 μm were prepared.

One hundred (100) parts of the mother toner particles were mixed with 1.0 part of a hydrophobized silica R974 (from Nippon Aerosil Co., Ltd.) and 1.0 part of a hexamethylenedisilazane-treated hydrophobized silica AEROSIL 90G (from Nippon Aerosil Co., Ltd., having a BET surface area of 65 $m^2/g$, a pH of 6.0, and a hydrophobized ratio of 60%) using a HENSCHEL MIXER for 90 seconds at a revolution speed of 30 m/sec. The mixture was sieved with a screen having openings of 75 μm.

Thus, a toner (1) was prepared.

Example 1 to 13 and Comparative Example 1 to 11

The procedure for preparation of the toner (1) was repeated except the toner composition, the kneading conditions, and the cooling conditions were changed according to Table 3.

Especially in Example 8 and Comparative Example 11, a carnauba wax having a melting point of 82° C. was mixed with a binder resin and a master batch.

Thus, toners (1) to (13) and comparative toners (1) to (11) were prepared.

The toner composition, the kneading conditions, and the cooling condition of each of the prepared toners are shown in Table 3, and the wax particle diameter distribution of each of the prepared toners are shown in Table 4.

TABLE 3

| | Toner composition | | | Kneading conditions | | | Cooling condition |
|---|---|---|---|---|---|---|---|
| Example | Resin species (Mixing ratio) | Wax species (Tm) | Amount of wax (% by weight) | Screw revolution speed (rpm) | Kneading zone ratio (%) | Cylinder internal temperature (° C.) | Cooling roller thickness (mm) |
| Ex. 1 | AWI/F (60/40) | Paraffin (73° C.) | 4.2 | 100 | 70 | 100 | 2.0 |
| Ex. 2 | AWI/F (60/40) | Paraffin (73° C.) | 4.2 | 110 | 65 | 110 | 2.0 |
| Ex. 3 | AWI/F (60/40) | Paraffin (73° C.) | 4.2 | 90 | 75 | 85 | 2.0 |
| Ex. 4 | AWI/F (60/40) | Paraffin (73° C.) | 4.2 | 90 | 70 | 110 | 2.0 |
| Ex. 5 | AWI/F (60/40) | Paraffin (73° C.) | 4.2 | 80 | 75 | 90 | 2.0 |
| Ex. 6 | AWI/F (60/40) | Paraffin (73° C.) | 4.2 | 90 | 70 | 85 | 2.0 |
| Ex. 7 | AWII/F (60/40) | Paraffin (73° C.) | 4.2 | 100 | 75 | 100 | 2.0 |
| Ex. 8 | B/F (60/40) | Carnauba (82° C.) | 4.2 | 100 | 70 | 100 | 2.0 |
| Ex. 9 | AWIII/F (60/40) | Paraffin (79° C.) | 4.2 | 100 | 70 | 100 | 2.0 |
| Ex. 10 | CWI/F (60/40) | Paraffin (73° C.) | 4.2 | 110 | 70 | 110 | 2.0 |

TABLE 3-continued

| Example | Toner composition: Resin species (Mixing ratio) | Toner composition: Wax species (Tm) | Toner composition: Amount of wax (% by weight) | Kneading conditions: Screw revolution speed (rpm) | Kneading conditions: Kneading zone ratio (%) | Kneading conditions: Cylinder internal temperature (° C.) | Cooling condition: Cooling roller thickness (mm) |
|---|---|---|---|---|---|---|---|
| Ex. 11 | DWI/F (60/40) | Paraffin (73° C.) | 4.2 | 90 | 70 | 90 | 2.0 |
| Ex. 12 | AWI/F (50/50) | Paraffin (73° C.) | 3.5 | 110 | 70 | 110 | 2.0 |
| Ex. 13 | AWI/F (70/30) | Paraffin (73° C.) | 4.9 | 80 | 70 | 80 | 2.0 |
| Comp. Ex. 1 | AWI/F (60/40) | Paraffin (73° C.) | 4.2 | 70 | 45 | 70 | 2.0 |
| Comp. Ex. 2 | AWI/F (60/40) | Paraffin (73° C.) | 4.2 | 80 | 20 | 80 | 2.0 |
| Comp. Ex. 3 | AWI/F (60/40) | Paraffin (73° C.) | 4.2 | 120 | 45 | 140 | 2.0 |
| Comp. Ex. 4 | AWI/F (60/40) | Paraffin (73° C.) | 4.2 | 130 | 20 | 130 | 2.0 |
| Comp. Ex. 5 | AWI/F (60/40) | Paraffin (73° C.) | 4.2 | 80 | 45 | 80 | 2.0 |
| Comp. Ex. 6 | AWI/F (60/40) | Paraffin (73° C.) | 4.2 | 100 | 45 | 90 | 2.0 |
| Comp. Ex. 7 | AWI/F (60/40) | Paraffin (73° C.) | 4.2 | 110 | 45 | 120 | 2.0 |
| Comp. Ex. 8 | AWI/F (60/40) | Paraffin (73° C.) | 4.2 | 120 | 45 | 120 | 2.0 |
| Comp. Ex. 9 | AWI/F (40/60) | Paraffin (73° C.) | 2.8 | 100 | 70 | 100 | 2.0 |
| Comp. Ex. 10 | AWI/F (80/20) | Paraffin (73° C.) | 5.6 | 100 | 70 | 100 | 2.0 |
| Comp. Ex. 11 | B/F (60/40) | Carnauba (82° C.) | 4.2 | 150 | 15 | 120 | 0.5 |

TABLE 4

| | Wax particle diameter distribution property: less than 1.0 μm (% by number) | 0.75 to 1.0 μm (% by number) | 0.75 to 1.25 μm (% by number) | 1.0 to 2.0 μm (% by number) | Mode value (μm) |
|---|---|---|---|---|---|
| Ex. 1 | 46.0 | 27.0 | 50.0 | 50.0 | 0.90 to 0.95 |
| Ex. 2 | 36.0 | 23.0 | 45.0 | 58.0 | 0.95 to 1.00 |
| Ex. 3 | 53.0 | 34.0 | 58.0 | 44.0 | 0.85 to 0.90 |
| Ex. 4 | 39.0 | 22.5 | 42.5 | 56.0 | 0.95 to 1.00 |
| Ex. 5 | 53.0 | 37.5 | 57.5 | 43.0 | 0.90 to 0.95 |
| Ex. 6 | 50.0 | 36.0 | 52.0 | 44.0 | 0.95 to 1.00 |
| Ex. 7 | 45.0 | 26.0 | 51.0 | 51.0 | 0.90 to 0.95 |
| Ex. 8 | 43.0 | 23.0 | 48.0 | 49.0 | 0.95 to 1.00 |
| Ex. 9 | 48.0 | 29.0 | 47.0 | 46.0 | 0.90 to 0.95 |
| Ex. 10 | 44.0 | 25.0 | 49.0 | 49.0 | 0.90 to 0.95 |
| EX. 11 | 48.0 | 28.0 | 50.0 | 46.0 | 0.80 to 0.85 |
| EX. 12 | 53.0 | 35.8 | 57.0 | 41.0 | 0.95 to 1.00 |
| Ex. 13 | 41.0 | 24.5 | 44.0 | 54.0 | 0.95 to 1.00 |
| Comp. Ex. 1 | 60.0 | 16.0 | 28.0 | 30.0 | 0.65 to 0.70 |
| Comp. Ex. 2 | 58.0 | 14.0 | 30.0 | 34.0 | 0.70 to 0.75 |
| Comp. Ex. 3 | 32.0 | 15.0 | 34.0 | 59.0 | 1.05 to 1.10 |
| Comp. Ex. 4 | 30.0 | 17.0 | 38.0 | 60.0 | 1.10 to 1.15 |
| Comp. Ex. 5 | 58.0 | 23.0 | 38.0 | 30.0 | 0.75 to 0.80 |
| Comp. Ex. 6 | 54.0 | 20.0 | 34.0 | 37.0 | 0.70 to 0.75 |
| Comp. Ex. 7 | 32.0 | 21.0 | 41.0 | 56.0 | 0.95 to 1.00 |
| Comp. Ex. 8 | 36.0 | 13.0 | 35.0 | 56.0 | 1.05 to 1.10 |

TABLE 4-continued

| | Wax particle diameter distribution property: less than 1.0 μm (% by number) | 0.75 to 1.0 μm (% by number) | 0.75 to 1.25 μm (% by number) | 1.0 to 2.0 μm (% by number) | Mode value (μm) |
|---|---|---|---|---|---|
| Comp. Ex. 9 | 57.0 | 22.0 | 40.0 | 34.0 | 0.70 to 0.75 |
| Comp. Ex. 10 | 30.0 | 18.0 | 44.0 | 60.0 | 1.00 to 1.05 |
| Comp. Ex. 11 | 40.5 | 10.0 | 18.0 | 19.0 | 1.20 to 1.25 |

Toner Evaluation Method

(1) Separativeness

A toner was set in a full color printer LP-3000C (from Seiko Epson Corporation) adopting a non-magnetic one-component developing method. Unfixed 36 mm-wide solid image (toner content of 1.1±0.1 mg/cm$^2$) was formed on A4 size paper at a position of 3 mm behind the tip thereof while the A4 size paper was fed in the vertical direction. The thus prepared unfixed images were fixed using the fixing device 20 (illustrated in FIG. 2) at various fixing temperatures to determine a toner-fixable temperature range in which a paper can well separate from a heating roller and offset problem does not occur, under the conditions of 27° C. and 80% RH (i.e., high temperature and high humidity). The paper used for the evaluation was TYPE 6200 having cross direction (from Ricoh Company, Ltd.).

The fixing device 20 includes a soft roller covered by a fluorocarbon resin. In particular, the heating roller 21 has an outer diameter of 40 mm, and including the aluminum cored bar 24, the elastic layer 25 made of a silicone rubber and having a thickness of 1.5 mm, the outermost layer 26 made of a PFA, and the heater 27 located inside the aluminum cored bar 24. The pressing roller 22 has an outer diameter of 35 mm, and including the aluminum cored bar 28, the elastic layer 29 made of a silicone rubber and having a thickness of 3 mm, and the outermost layer 30 made of a PFA. The 7 mm-wide nip 31 is formed between the heating roller 21 and the pressing roller 22. The fixing device 20 further includes the separation plate 23 configured to separate a recording sheet having a fixed toner image thereon from the heating roller 21. A fixing oil is not used in the fixing device 20. The revolution speed of the rollers is 125 mm/sec.

The separativeness was graded as follows:

Good: the toner-fixable temperature range was not less than 50° C.

Average: the toner-fixable temperature range was not less than 30° C. and less than 50° C.

Poor: the toner-fixable temperature range was less than 30° C.

(2) Thermostable Preservability

A toner was preserved for 8 hours at 50° C., followed by sieving with a 42-mesh screen for 2 minutes. Thermostable preservability of the toner was evaluated by the residual ratio of the toner remaining on the screen.

The residual ratio was evaluated as follows:

Very good: less than 10%

Good: not less than 10% and less than 20%

Average: not less than 20% and less than 30%

Poor: not less than 30%

(3) Image Glossiness

A toner was set in a full color printer LP-3000C (from Seiko Epson Corporation). Unfixed square-shaped solid image having a size of 1.5 cm×1.5 cm (toner content of 1.1±0.1 mg/cm$^2$) was formed on the paper. The unfixed image was fixed using the fixing device 20 (illustrated in FIG. 2) at a fixing temperature of 160° C. The glossiness of the fixed image was measured using a gloss meter GM-060 (from Konica Minolta Holdings, Inc.)

The glossiness was evaluated as follows:

Good: not less than 5

Average: not less than 3 and less than 5 (no problem in use)

Poor: not less than 3 (having problem in use)

(4) Toner Filming

A toner was set in a full color printer LP-3000C (from Seiko Epson Corporation). A running test in which 1,000 copies of a chart having an image area proportion of 6% were continuously produced was performed at 27° C. and 80% RH (i.e., high temperature and high humidity). A photoreceptor and an intermediate transfer belt were visually observed to determine whether toner film and black spot were formed thereon.

The evaluation was performed as follows:

Good: Toner film and black spot were not observed on both the photoreceptor and the intermediate transfer belt.

Average: Toner film and black spot were observed on either the photoreceptor or the intermediate transfer belt, but were not observed on the produced image. No problem in use.

Poor: Toner film and black spot were observed on either the photoreceptor and/or the intermediate transfer belt, and also observed on the produced image. Having problem in use.

(5) Toner Adhesion

A toner was set in a full color printer LP-3000C (from Seiko Epson Corporation). A running test in which 1,000 copies of a chart having an image area proportion of 6% were continuously produced was performed at 27° C. and 80% RH (i.e., high temperature and high humidity). A developing sleeve was visually observed to determine whether the toner firmly adheres thereto.

The evaluation was performed as follows:

Good: The toner did not adhere to the developing sleeve.

Average: Small amount of toner streaky adhered to the developing sleeve, but the produced image had no problem.

Poor: Large amount of toner streaky adhered to the developing sleeve, and abnormal phenomenon (e.g., usual noise, toner spill) was occurred. Having problem in use.

The results of the evaluations of the toners are shown in Table 6.

TABLE 6

| | Softening point Tm (° C.) | Evaluation results | | | | |
|---|---|---|---|---|---|---|
| | | Separativeness | Glossiness | Toner adhesion | Toner filming | Thermostable preserveability |
| Ex. 1 | 123.1 | Good | Good | Good | Good | Good |
| Ex. 2 | 122.7 | Good | Good | Average | Good | Average |
| Ex. 3 | 121.8 | Average | Good | Good | Good | Good |
| Ex. 4 | 122.6 | Good | Good | Good | Good | Average |
| Ex. 5 | 122.2 | Average | Good | Good | Good | Good |
| Ex. 6 | 121.6 | Good | Good | Good | Good | Good |
| Ex. 7 | 123.6 | Good | Good | Good | Average | Good |
| Ex. 8 | 123.9 | Average | Good | Average | Average | Average |
| Ex. 9 | 123.1 | Average | Good | Average | Average | Good |
| Ex. 10 | 126.3 | Good | Average | Good | Good | Good |
| Ex. 11 | 118.5 | Average | Good | Average | Average | Average |
| Ex. 12 | 121.2 | Average | Good | Good | Good | Good |
| Ex. 13 | 125.3 | Good | Good | Average | Average | Average |
| Comp. Ex. 1 | 122.7 | Poor | Good | Good | Good | Average |
| Comp. Ex. 2 | 122.2 | Poor | Good | Good | Average | Average |
| Comp. Ex. 3 | 123.7 | Good | Average | Poor | Poor | Poor |
| Comp. Ex. 4 | 123.4 | Good | Average | Poor | Poor | Poor |
| Comp. Ex. 5 | 122.9 | Poor | Good | Good | Good | Good |
| Comp. Ex. 6 | 122.8 | Poor | Good | Good | Good | Good |
| Comp. Ex. 7 | 123.5 | Good | Good | Average | Poor | Average |

TABLE 6-continued

| | Softening point Tm (° C.) | Evaluation results | | | | |
|---|---|---|---|---|---|---|
| | | Separativeness | Glossiness | Toner adhesion | Toner filming | Thermostable preserveability |
| Comp. Ex. 8 | 123.1 | Good | Good | Average | Poor | Average |
| Comp. Ex. 9 | 119.6 | Poor | Good | Good | Good | Good |
| Comp. Ex. 10 | 127.3 | Good | Poor | Poor | Poor | Poor |
| Comp. Ex. 11 | 124.3 | Poor | Average | Poor | Poor | Poor |

It is clear from Table 6 that the toners of the present invention, i.e., Examples 1 to 13, show good results in all the evaluations. In contrast, toners of Comparative Examples 1 to 11 have poor property in some evaluation results.

This document claims priority and contains subject matter related to Japanese Patent Applications Nos. 2005-177506 and 2006-107554, filed on Jun. 17, 2005, and Apr. 10, 2006, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising: a binder resin; a wax; and a colorant, wherein particles of the wax having a particle diameter of less than 1.00 μm are included in the toner in an amount of not less than 35% by number and less than 55% by number, and wherein the wax has a particle diameter distribution property such that when particle diameters of particles of the wax are classified into ranges having a width of 0.05 μm, the wax has a particle diameter mode value that is not less than 0.75 μm and less than 1.00 μm;

and wherein particles of the wax having a particle diameter of not less than 1.00 μm and less than 2.00 μm are included in the toner in an amount of not less than 42.5% by number and less than 55% by number.

2. The toner according to claim 1, wherein particles of the wax having a particle diameter of not less than 0.75 μm and less than 1.00 μm are included in the toner in an amount of not less than 20% by number and less than 35% by number.

3. The toner according to claim 1, wherein particles of the wax having a particle diameter of not less than 0.75 μm and less than 1.25 μm are included in the toner in an amount of not less than 45% by number and less than 55% by number.

4. The toner according to claim 1, wherein the wax is a hydrocarbon wax.

5. The toner according to claim 1, wherein the wax has a melting point of from 65 to 75° C.

6. The toner according to claim 1, wherein the binder resin comprises: a first binder resin having a softening point of not less than 100° C. and less than 120° C.; and a second binder resin having a softening point of from 120 to 140° C., in an amount of from 50 to 75% by weight based on the first binder resin.

7. The toner according to claim 6, wherein the second binder resin is a hybrid resin comprising a condensation resin skeleton and a vinyl resin skeleton.

8. The toner according to claim 7, wherein the condensation resin skeleton is a polyester resin skeleton.

9. The toner according to claim 1, wherein the toner comprises the wax in an amount of from 3.5 to 5.0% by weight based on a total weight of the binder resin and the wax.

10. The toner according to claim 1, wherein the toner has a softening point of from 115 to 130° C.

11. The toner according to claim 1, wherein the toner is a non-magnetic toner.

12. A fixing method, comprising: heating a toner image on a recording material with an oilless fixing device to fix the toner image on the recording material, wherein the toner is the toner according to claim 1.

13. An image forming method, comprising: charging an image bearing member; irradiating the charged image bearing member with a light containing image information to form an electrostatic latent image on a surface of the image bearing member; developing the electrostatic latent image with a developer including a toner to form a toner image on the surface of the image bearing member; transferring the toner image onto a recording material; and fixing the toner image on the recording material, wherein the toner is the toner according to claim 1.

* * * * *